US006580339B2

(12) United States Patent
Kuroda

(10) Patent No.: US 6,580,339 B2
(45) Date of Patent: Jun. 17, 2003

(54) DIELECTRIC DUPLEXER AND COMMUNICATION APPARATUS

(75) Inventor: Katsuhito Kuroda, Matsutou (JP)

(73) Assignee: Murata Manufacturing Co. Ltd (JP)

( * ) Notice: Subject to any disclaimer, the term of this patent is extended or adjusted under 35 U.S.C. 154(b) by 0 days.

(21) Appl. No.: 10/118,718

(22) Filed: Apr. 8, 2002

(65) Prior Publication Data

US 2002/0145486 A1 Oct. 10, 2002

(30) Foreign Application Priority Data

Apr. 10, 2001 (JP) ..... 2001-111160
Feb. 21, 2002 (JP) ..... 2002-045048

(51) Int. Cl.[7] ..... H01P 1/201
(52) U.S. Cl. ..... 333/134; 333/206
(58) Field of Search ..... 333/134, 206, 333/207, 222, 202

(56) References Cited

U.S. PATENT DOCUMENTS 5,696,473 A * 12/1997 Tsujiguchi et al. ..... 333/202
5,929,725 A * 7/1999 Toda et al. ..... 333/202
6,177,852 B1 * 1/2001 Tada et al. ..... 333/202
6,496,088 B1 * 12/2002 Okada et al. ..... 333/202

* cited by examiner

*Primary Examiner*—Seungsook Ham
(74) *Attorney, Agent, or Firm*—Dickstein, Shapiro, Morin & Oshinsky, LLP.

(57) ABSTRACT

A dielectric duplexer contains a substantially-rectangular-parallelepiped-shaped dielectric block. The dielectric block includes plated through holes having inner conductors formed thereon. An outer conductor is formed on an exterior surface of the dielectric block. An input/output terminal is formed by an outer-conductorless portion separating the input/output terminal from the outer conductor of the plated through holes and is defined by an outer-conductorless portion extending from a short circuit face of the dielectric block to a mounting surface thereof. An antenna excitation hole is formed as a through-hole in the same axial direction as that of the plated through holes in the dielectric block. The antenna excitation hole contains an electrode which is coupled to the antenna terminal. Two electrodeless portions, each having a predetermined shape, are formed between open edges of two plated through holes and a top face of the dielectric block.

16 Claims, 9 Drawing Sheets

DIELECTRIC DUPLEXER AND COMMUNICATION APPARATUS

BACKGROUND OF THE INVENTION

1. Field of the Invention

The present invention relates to integral-type dielectric duplexers using dielectric blocks, which are provided in mobile communication devices, and to communication apparatuses which include the same.

2. Description of the Related Art

Referring to FIG. 11, the structure of a known dielectric duplexer will now be described.

A substantially-rectangular-parallelepiped-shaped dielectric block 1 includes a plurality of plated through holes 2*a* to 2*f* containing inner conductors 3*a* to 3*f*, respectively. The inner conductors on the plated through holes define respective resonant cavities. An outer conductor 4 is formed on substantially the entire exterior surface of the dielectric block 1. In the vicinity of first ends of the plated through holes 2*a* to 2*f* (the right back side of the plated through holes as viewed in FIG. 11), inner-conductorless portions 33*a* to 33*f* are provided, thus forming open ends of the resonant cavities. Second ends (the left front side as viewed in FIG. 11) of the plated through holes are short-circuit ends which are directly coupled to the outer conductor 4. The face of the dielectric block located adjacent the short-circuit ends of the resonant cavities will be referred to as the short-circuit end face of the duplexer. In accordance with this structure a plurality of dielectric resonators are formed.

An input/output terminal 5 extends from a right side face of the dielectric block to a mounting surface (the bottom face in FIG. 11) of the dielectric block 1 which is opposed to a mounting board. The input/output terminal 5 is separated from the outer conductor 4 by an outer-conductorless portion 6 located therebetween. Although not shown in FIG. 11, a second input/output terminal is preferably formed extending from a left side face (opposite the right side face) to the bottom mounting surfaces. An antenna terminal 7 is formed between the plated through holes 2*c* and 2*d* and is separated from the outer conductor 4 by an outer-conductorless portion 8. The antenna terminal 7 extends from the short-circuit end face to the mounting surface. An antenna excitation hole 9 is formed as a through-hole in the same axial direction as that of the plated through holes 2*a* to 2*f* in the dielectric block 1. An electrode is formed on the inner surface of the antenna excitation hole 9 and is electronically coupled to the antenna terminal 7.

A first portion of the duplexer containing plated through holes 2*a* to 2*c* and a second portion of the duplexer containing the inner-conductor-formed holes 2*d* to 2*f* each function as a three-stage dielectric filer in which the resonant cavities formed by the inner conductors of the plated through holes are coupled to one another. The first portion is typically regarded as a transmitter filter and the second portion is typically regarded as a receiver filter.

The above-described known dielectric duplexer has the following problems.

FIG. 12 illustrates an enlarged section of the duplexer of FIG. 11 showing the distribution of ground current on a portion of the short-circuit end face thereof.

FIG. 12 shows the plated through holes 2*d* and 2*e*, the inner conductors 3*d* and 3*e*, the outer conductor 4, the antenna terminal 7, the outer-conductorless portion 8, the antenna excitation hole 9, a top electrode 10, which is part of the outer conductor, and a bottom electrode 11, which is also part of the outer conductor.

In response to a signal input to the dielectric duplexer, current flows from the inner electrodes to the outer conductor, which acts as a ground electrode. As shown in FIG. 12 the current flowing from the inner conductor 3*e* to the top electrode 10 is substantially equal to the current flowing from the inner conductor 3*e* to the bottom mounting electrode 11. As a result, there is substantially no potential difference between the top electrode 10 and the bottom electrode 11 in the area of the plated through hole 2*e*, and a TE (transverse electric) mode having an electric field component perpendicular to the top electrode 10 and the bottom electrode 11 is not excited.

In contrast, such a mode is excited in the area of the plated through hole 2*d* because of the presence of the outer-conductorless portion 8 which is provided on the short-circuit end face and the bottom mounting surface of the dielectric block, but not on the top surface thereof A current flowing from the inner conductor 3*d* adjacent to the antenna terminal 7 to the top electrode 10 is greater than a current flowing from the inner conductor 3*d* to the bottom electrode 11. Thus, a potential difference is generated between the top electrode 10 and the bottom electrode 11, and hence an electric field is generated. Accordingly, the TE mode having an electric field component perpendicular to the top electrode 10 and the bottom electrode 11 is excited.

Generally in a duplexer, the attenuation band of a transmitter filter is the pass band of a receiver filter, and the attenuation band of the receiver filter is the pass band of the transmitter filter. When a resonator forming the receiver filter, particularly a resonator adjacent to an antenna excitation hole, excites a TE mode in the pass band of the receiver filter, part of a transmission signal passing through the transmitter filter couples with the resonator forming the receiver filter, and the coupled signal is transmitted to the antenna excitation hole. Thus, the attenuation characteristic of the transmitter filter deteriorates significantly. In contrast, when a resonator forming the transmitter filter, particularly a resonator adjacent to the antenna excitation hole, excites the TE mode in the pass band of the transmitter filter, the attenuation characteristic of the receiver filter deteriorates significantly.

When a wave in a TE mode propagates between the transmitter filter and the receiver filter, the attenuation characteristics deteriorate.

SUMMARY OF THE INVENTION

Accordingly, it is an object of the present invention to provide a dielectric duplexer which has a simple structure having improved attenuation characteristics by reducing the excitation of undesirable modes in which a wave propagates between filters and to provide a communication apparatus using the same.

According to an aspect of the present invention, a dielectric duplexer comprises:

a dielectric block having an outer surface including top, bottom, front and rear surfaces;

a plurality of plated through holes extending through the dielectric block between the front to the rear surfaces thereof, each of the plated through holes having a respective inner conductor formed on an inner surface thereof;

an antenna excitation hole extending through the dielectric block from the front to the rear surface thereof, the antenna excitation hole having an electrode formed on an inner surface thereof;

an outer conductor located on the outer surface of the dielectric block and being directly connected to the inner conductors at the front surface of the dielectric block;

input/output terminals located on the outer surface of the dielectric block and being spaced from the outer conductor;

an antenna terminal located on the front surface and being directly coupled to the antenna excitation hole electrode, the antenna terminal being separated from the outer conductor by a conductorless area extending from the front to the bottom surfaces of the dielectric block; and means for adjusting the relative flow of current through the outer conductor between the inner electrode of a first one of the plated through holes which is located adjacent the antenna terminal and the upper and lower surfaces of the dielectric block so as to cause the two current flows to be substantially equal.

The adjusting means may include at least one electrodeless portion formed on the outer conductor located on the front face of the dielectric block and located adjacent the antenna excitation hole. The embodiment makes it possible to tune the duplexer by removing portions of the outer conductor.

The adjusting means may alternatively be a portion of the first plated through hole which terminates at the front surface of the dielectric block and is located closer to the bottom surface than the top surface. The first plated through hole can have a single central axis or can be offset with two parallel but spaced central axes. Accordingly, when a mold is set in advance so as to obtain the desired characteristics, a dielectric duplexer having improved attenuation characteristics can be easily formed without processing the outer shape of the dielectric duplexer.

The adjusting means can also be an indentation formed in the front surface of the dielectric block so as to adjust the relative flow of current between the inner conductor of the first plated through hole and the top and bottom surfaces of the dielectric block. In the preferred embodiment, the indentation comprises a planar surface extended, at an oblique angle to the top and bottom surfaces of the dielectric block. In accordance with this embodiment, a dielectric duplexer can be easily formed without using a plated through hole having a complicated shape.

According to another aspect of the present invention, a communication apparatus including the foregoing dielectric duplexer is provided. Accordingly, a communication apparatus having improved communication characteristics can be easily formed.

DESCRIPTION OF THE PREFERRED EMBODIMENTS

Referring to FIGS. 1A to 1C and FIG. 2, the structure of a dielectric duplexer according to a first embodiment of the present invention will now be described.

Figure 1A:
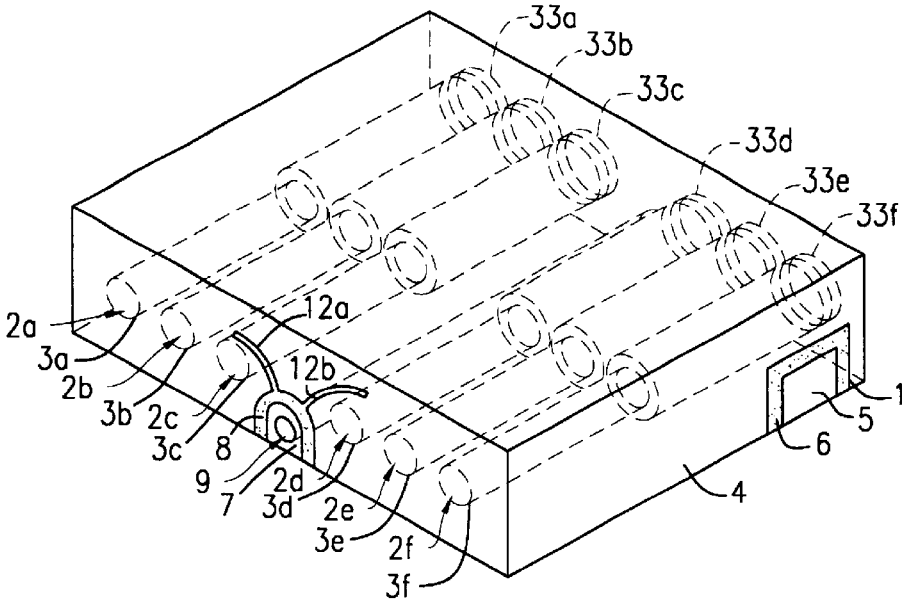
FIG. 1A is an external perspective view of a dielectric duplexer according to a first embodiment of the present invention.
Figure 1B:
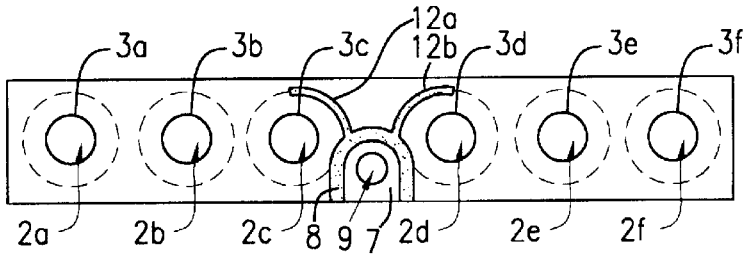
FIG. 1B is an elevation view of a short-circuit end face of the dielectric duplexer shown in FIG. 1A.
Figure 1C:
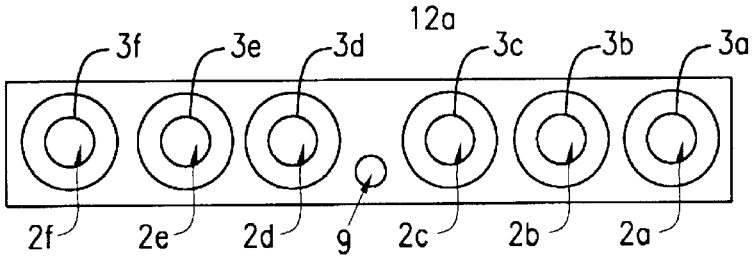
FIG. 1C is an elevation view of an open end face of the dielectric duplexer shown in FIG. 1A.

FIG. 1A is an external perspective view of the dielectric duplexer. FIG. 1B is an elevation view of the dielectric duplexer viewed from the front surface (a short-circuit end face) of the dielectric block. FIG. 1C is an elevation view of the dielectric duplexer viewed from the rear surface (an open end face) of the dielectric block.

A substantially-rectangular-parallelepiped-shaped dielectric block 1 contains a plurality of plated through holes 2*a* to 2*f* having respective inner conductors 3*a* to 3*f* formed thereon. The inner conductors form respective resonant cavities. An outer conductor 4 is formed on an exterior surface of the dielectric block 1. In the vicinity of first ends of the plated through holes 2*a* to 2*f* (the right back side in FIG. 1A), inner-conductorless portions 33*a* to 33*f* are provided, respectively, thus forming open ends of the resonant cavities. The rear end surface of the dielectric block at which the open ends of the plated through holes terminate will be referred to as the open end face of the dielectric block.

The second ends of the plated through holes are directly coupled to the outer (ground) conductor 4 forming short circuit ends of the resonant cavities. The front surface of the dielectric block 1 (the left front end surface in FIG. 1A) at which the short circuit ends of the plated through holes terminate will be referred to as the short-circuit end face of the dielectric block. The inner conductors 3*a* to 3*f*, in conjunction with the dielectric block 1 and the outer conductor 4, form respective dielectric resonators. The plated through holes 2*a* to 2*f* preferably have stepped structures in which the internal diameter of the plated through holes adjacent the short-circuit end face is smaller than the internal diameter at the open end face.

An outer-conductorless portion 6 is provided on the exterior surface of the dielectric block 1. The outer-conductorless portion 6 extends from a lateral side surface of the dielectric block (the lower right side as viewed in FIG. 1A) to a mounting surface (the bottom surface in FIG. 1A) opposed to a mounting board. The outer-conductorless portion defines an input/output terminal 5 which is separated from the outer conductor 4. Although not shown in FIG. 1A, a second input/output terminal extending from the left lateral side surface of the dielectric block 1 to the bottom surface is thereof also provided.

An antenna terminal 7 is formed between the plated through holes 2*c* and 2*d* and is separated from the outer conductor 4 by an outer-conductorless portion 8 which extends from the short-circuit end face of the dielectric block 1 to the mounting surface thereof. The antenna excitation hole 9 extends through the dielectric block in the same direction as the plated through holes 2*a* to 2*f* and has an inner electrode formed thereon. An Antenna terminal 7, coupled to the inner conductor of the excitation hole 9, extends from the short circuited end face of the dielectric block to the bottom (mounting) surface thereof.

A first portion containing the plated through holes 2*a* to 2*c* and a second portion containing the plated through 2*d* to 2*f* each function as a dielectric filter having a three-stage resonator in which the resonators are coupled with one another. The first portion is generally regarded as a transmitter filter and the second portion is regarded as a receiver filter.

Electrodeless portions 12*a* and 12*b* are formed on the short-circuit end face of the dielectric block between open edges of the plated through holes 2*d* and 2*c* and the top surface of the dielectric block 1. In this embodiment, the electrodeless portions 12*a* and 12*b* extend to the outer-conductorless portion 8. In accordance with the length of the electrodeless portions 12*a* and 12*b*, a current flowing through the outer conductor 4 located on the short circuit end surface (the front surface) of the dielectric block from the inner conductors 3*d* and 3*c* to the top electrode (the outer conductor on the top surface of the dielectric block) is controlled. In order to prevent deterioration of QO of the filters, it is desirable to make the width of the electrodeless portions 12*a* and 12*b* as small as possible within the allowable processing range of the manufacturing process.

When arranged as described above, there is substantially no potential difference between the top electrode and the bottom electrode. Thus, the excitation of a TE mode having an electric field component perpendicular to the top and bottom electrodes is prevented.

Since the excitation of the TE mode is suppressed, the coupling of a wave in an undesirable mode with the resonators forming the other filter is prevented or at least suppressed. Also, the coupling of a wave in an undesirable mode with the inner electrode formed in the antenna excitation hole 9 is prevented or at least suppressed. As a result, the attenuation characteristics are improved.

In the first embodiment, the electrodeless portions 12*a* and 12*b* extend to the outer-conductorless portion 8 of the antenna terminal 7. Alternatively, the electrodeless portions 12*a* and 12*b* can be separated from the outer-conductorless portion 8. In the latter case, current concentrates at the separation point. The current is significantly influenced by the shape of the separation point. Because processing variations have a strong influence on the current, it is preferable that the electrodeless portions 12*a* and 12*b* extend to the outer-conductorless portion 8.

Since the characteristics can be improved by partially removing the outer conductor 4 to form the electrodeless portions 12*a* and 12*b*, the characteristics of the duplexer can be finely tuned by trimming the outer conductor 4 around the electrodeless portions 12*a* and 12*b* after the dielectric duplexer has been formed.

Figure 2:
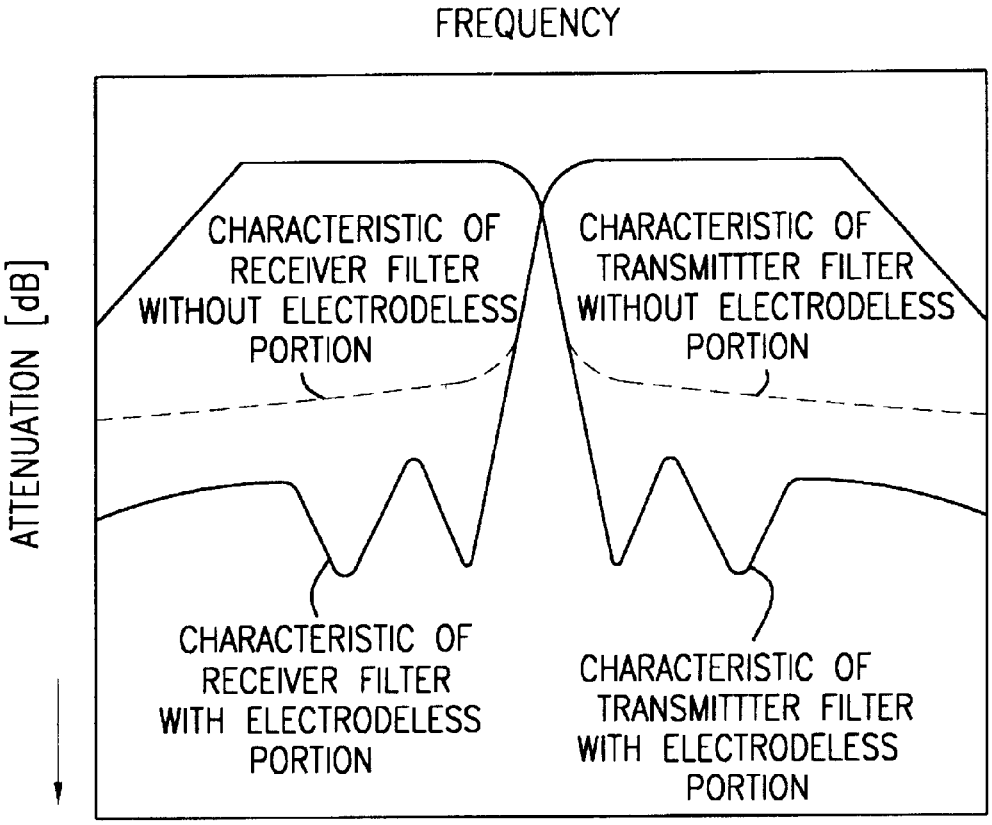
FIG. 2 illustrates a transmission characteristic of the dielectric duplexer 1A through 1C.

FIG. 2 illustrates the transmission characteristic of the dielectric duplexer when a filter containing the plated through holes 2*a* to 2*c* is a transmitter filter and a filter containing the plated through holes 2*d* to 2*f* is a receiver filter. Referring to FIG. 2, solid lines represent the transmission characteristic of the dielectric duplexer with the electrodeless portions 12*a* and 12*b*. In contrast, broken lines represent the transmission characteristic of a conventional structure without the electrodeless portion.

As shown in FIG. 2, the transmitter filter has an attenuation pole at the high frequency side of the pass band of the transmitter filter, that is, at the pass band side of the receiver filter. The attenuation increases at the attenuation pole. The receiver filter has an attenuation pole at the low frequency side of the pass band of the receiver filter, that is, at the pass band side of the transmitter filter. The attenuation increases at the attenuation pole. Accordingly, the transmission characteristics of each filter are improved, and the influence of the other filter is suppressed.

Referring to FIGS. 3A to 3C, FIG. 4, and FIG. 5, the structure of a dielectric duplexer according to a second embodiment of the present invention will now be described.

Figure 3A:
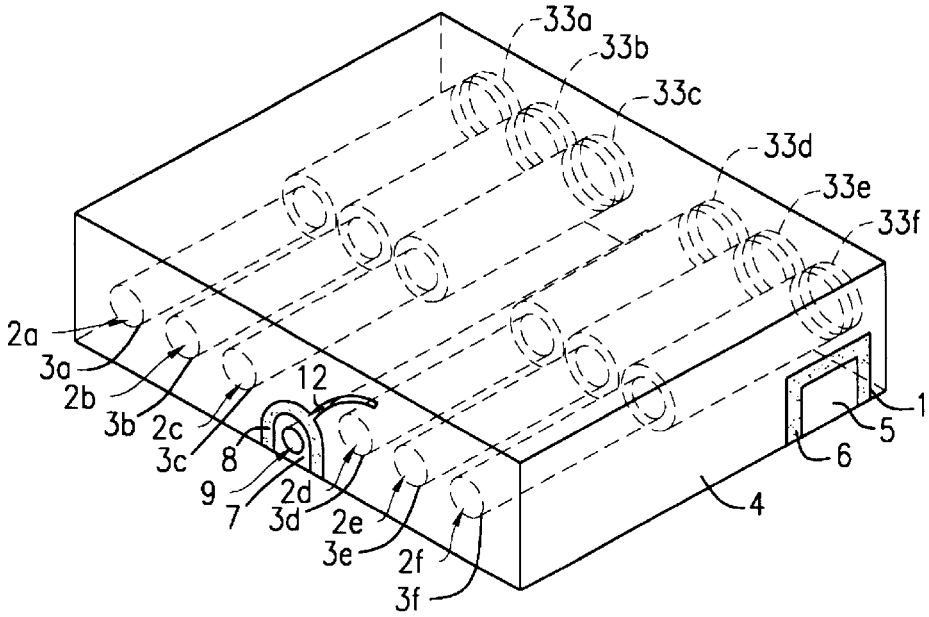
FIG. 3A is an external perspective view of a dielectric duplexer according to a second embodiment of the present invention.
Figure 3B:
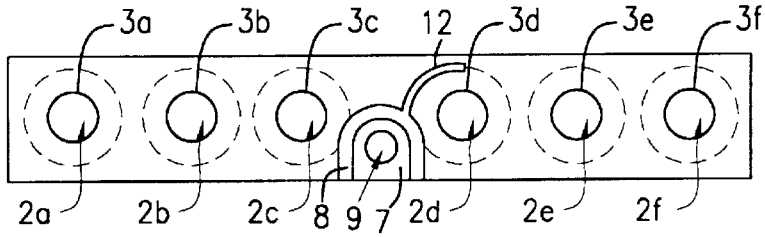
FIG. 3B is an elevation view of a short-circuit end face of the dielectric duplexer shown in FIG. 3A.
Figure 3C:
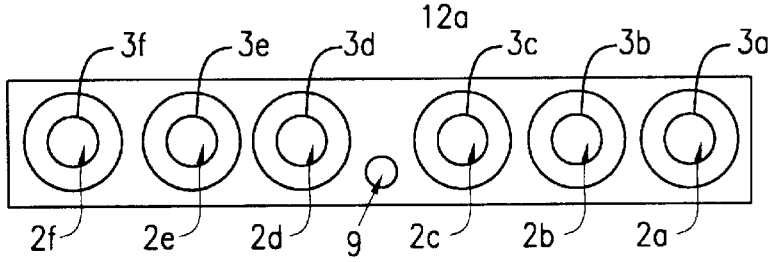
FIG. 3C is an elevation view of an open end face of the dielectric duplexer shown in FIG. 3A.

FIG. 3A is an external perspective view of the dielectric duplexer. FIG. 3B is an elevation view of the dielectric duplexer viewed from a front surface (a short-circuit end face) of the dielectric block. FIG. 3C is an elevation view of the dielectric duplexer viewed from a rear surface (an open end face) of the dielectric block.

In the dielectric duplexer shown in FIGS. 3A to 3C, a single electrodeless portion 12 is formed at the front face of the dielectric block 1. The remaining structure is the same as that of the dielectric duplexer shown in FIG. 1.

The transmission characteristic and the isolation characteristic of the dielectric duplexer when a filter containing the plated through 2*a* to 2*c* is a transmitter filter and a filter containing the plated through holes 2*d* to 2*f* is a receiver filter will now be described.

Figure 4:
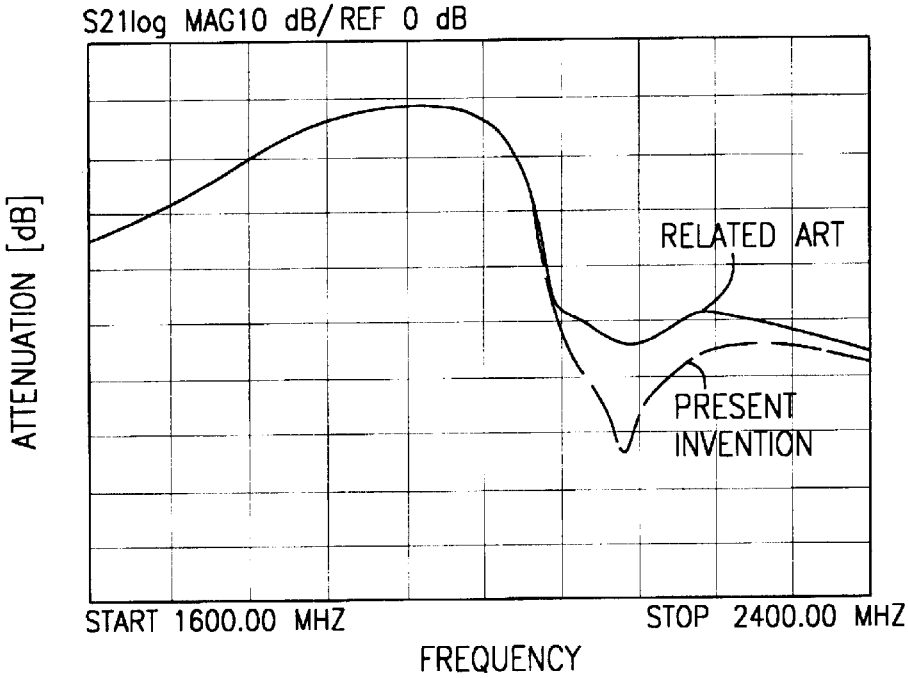
FIG. 4 illustrates a transmission characteristic between an input terminal and an antenna terminal.
Figure 5:
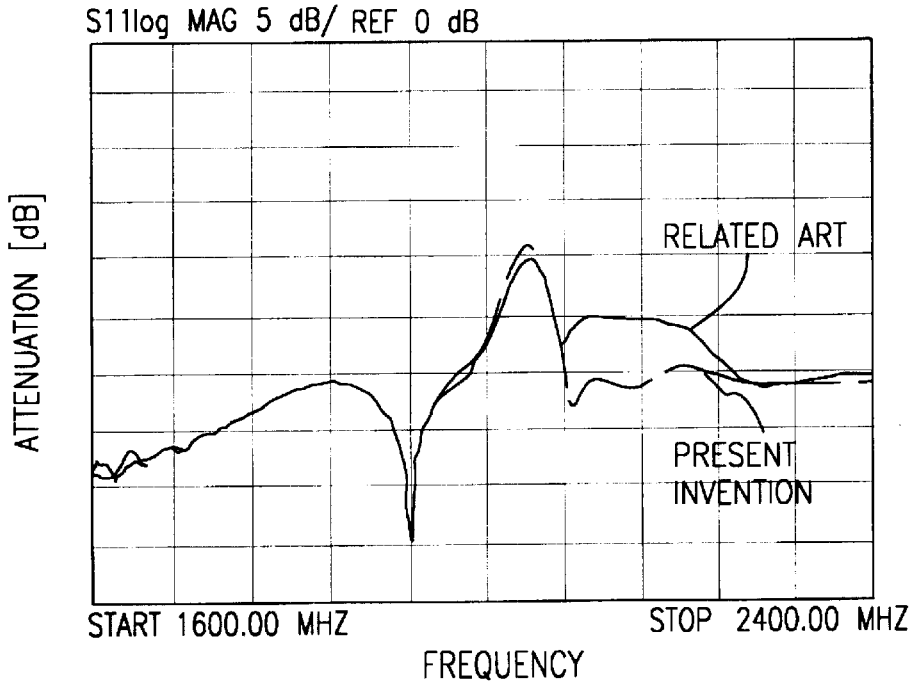
FIG. 5 illustrates an isolation characteristic between the input terminal and an output terminal.

FIG. 4 illustrates the transmission characteristic between an input terminal and an antenna terminal of the transmitter filter. FIG. 5 illustrates the isolation characteristic between the input terminal and an output terminal of the dielectric duplexer. As shown in FIG. 4, the attenuation increases at the higher frequency side of the pass band, and hence the transmission characteristics of the transmitter filter are improved. As shown in FIG. 5, the isolation characteristics of the overall dielectric duplexer are improved.

Figure 6:
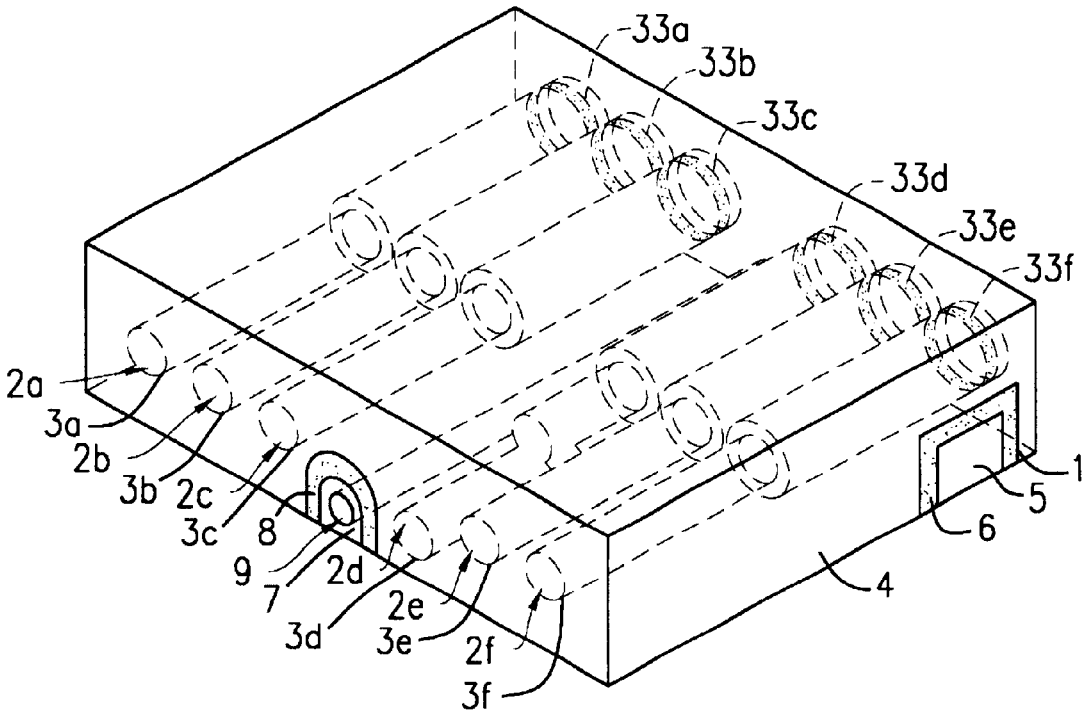
FIG. 6 is an external perspective view of a dielectric duplexer according to a third embodiment of the present invention.
Figure 7A:
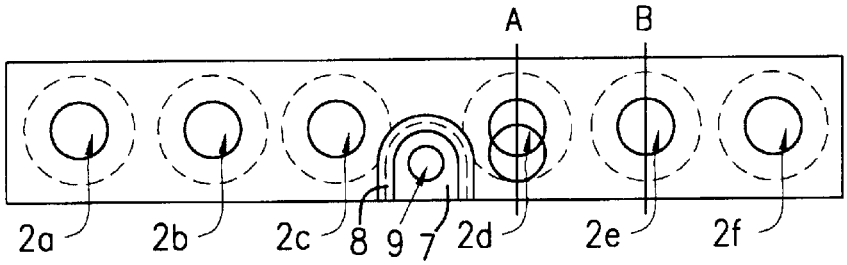
FIG. 7A is an elevation view of a dielectric duplexer according to a third embodiment of the present invention.
Figure 7B:
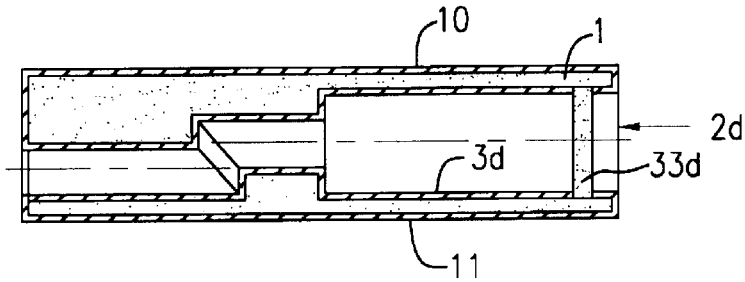
FIGS. 7B and 7C are lateral sectional views of the dielectric duplexer shown in FIG. 7A.
Figure 7C:
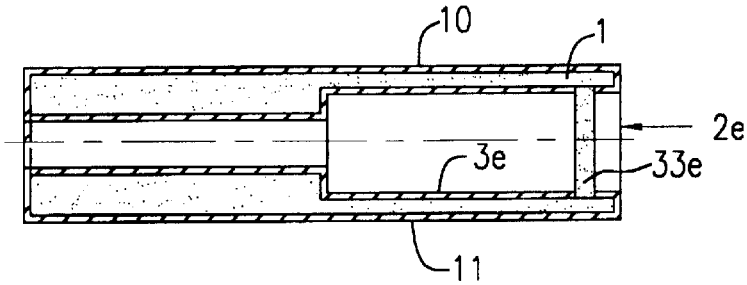
Figure 8:
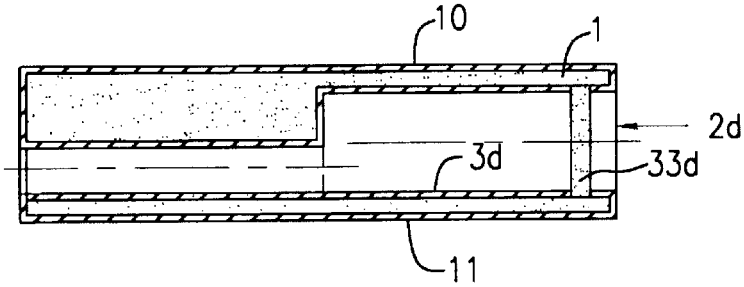
FIG. 8 is a lateral sectional view of a dielectric duplexer.

Referring to FIGS. 6 to 8, the structure of a dielectric duplexer according to a third embodiment of the present invention will now be described.

FIG. 6 is an external perspective view of the dielectric duplexer. FIG. 7A is an elevation view of the dielectric duplexer viewed from front surface (a short-circuit end face) of the dielectric block. FIG. 7B is a lateral sectional view of portion A of the dielectric duplexer shown in FIG. 7A. FIG. 7C is a lateral sectional view of portion B of the dielectric duplexer shown in FIG. 7A. FIG. 8 is a lateral sectional view of a dielectric duplex having another structure.

As shown in FIGS. 6 through 8, a substantially-rectangular-parallelepiped-shaped dielectric block 1 contains a plurality of plated through holes 2*a* to 2*f* having respective inner conductors 3*a* to 3*f* formed thereon. An outer conductor 4 is formed on the exterior surface of the dielectric block 1. In the vicinity of first ends of the plated through holes 2*a* to 2*f* (the right back side in FIG. 6), inner-conductorless portions 33*a* to 33*f* are provided, respectively, thus forming open ends of the resonant cavities formed by the inner conductors 3*a* to 3*f*. The open ends of the resonant cavities terminate adjacent the rear surface of the dielectric block (as viewed in FIG. 6) which will be referred to as the open end surface of the dielectric block 1. The other ends of the inner conductors 3*a* through 3*f* are directly coupled to the outer conductor 4 at the front surface of the dielectric block to form short-circuited ends of the resonant cavities. This front surface of the dielectric block will be referred to herein as the short circuit end face. The plated through holes 2*a* to 2*f* preferably have stepped structures in which the internal diameter of the plated through holes 2*a* to 2*f* at the short-circuit end face is smaller than the internal diameter at the open end face. The inner conductors 3*a* to 3*f*, in conjunction with the dielectric block 1 and the outer conductor 4, form dielectric resonators.

As shown in FIG. 7B, the portion of the plated through hole 2*d* which is located adjacent the short-circuit end face (the front surface of the dielectric block) is bent so that its axial position at the short circuit end face and its axial position at the center of the dielectric block differ in the direction perpendicular to the top and bottom surfaces of the dielectric block. The axial position of the plated through hole 2*d* at the center is the same as that of the other plated through holes 2*a* to 2*c*, 2*e*, and 2*f*, whereas the axial position of the plated through hole 2*d* at the front surface of the dielectric block is shifted to the bottom electrode 11 in the direction perpendicular to the top and bottom surfaces thereof.

As best shown in FIG. 6, the input/output terminal 5, the antenna terminal 7, the antenna excitation hole 9, and the outer-conductorless portions 6 and 8 are the same as those of the first embodiment.

When arranged as described above, the distance between the inner conductor 3*d* and the bottom electrode 11 is reduced in the area adjacent the short circuited face (the front surface) of the dielectric block. In the foregoing embodiments, the current flowing from the inner conductor 3*d* to the bottom electrode 11 is smaller than the current flowing from the inner conductor 3*d* to the top electrode 10 due to the influence of the outer-conductorless portion 8. In the third embodiment, the current flowing from the inner conductor 3*d* to the bottom electrode 11 is increased, and hence the two currents flowing from the inner conductor 3*d* to the top electrode 10 and to the bottom electrode 11 can be adjusted. As a result, the current flowing from the inner conductor 3*d* to the top electrode 10 is made substantially equal to the current flowing from the inner conductor 3*d* to the bottom electrode 11. Thus, there is substantially no potential difference between the top electrode 10 and the bottom electrode 11. The excitation of a TE mode having an electric field component perpendicular to the top and bottom electrodes 10 and 11 can be prevented.

Since the TE mode excitation, for example, is suppressed the coupling of a wave in a TE mode generated by the transmitter filter with the resonators of the receiver filter is prevented. As a result, the propagation of the TE mode from an input/output terminal (input terminal) of the transmitter filter to the antenna terminal 7 through the resonators of the receiver filter is cut off. Thus, the coupling of a wave in an undesirable mode with the resonators forming the filter is prevented (or at least reduced), and the coupling of a wave in an undesirable mode with the antenna excitation hole 9 is prevented (or at least reduced). Accordingly, the attenuation characteristics are improved and it becomes unnecessary to provide an electrodeless portion on the outer conductor 4. The position of the plated through hole 2*d* can be determined in advance in order that desired characteristics can be achieved, and a corresponding mold can be formed. When a dielectric block is formed using the mold, a dielectric duplexer can be easily formed.

In the third embodiment, the part of the plated through hole 2*d* located adjacent the short-circuit end face (the front surface) is bent so as to bring the axial position of the plated through hole 2*d* at the end short circuited face closer to the bottom electrode 11. Alternatively, as shown in FIG. 8, the entire section of the entire section of the hole 2*d* located on the short-circuit end face side of the dielectric block can be formed to be close to the bottom electrode 11.

Figure 9A:
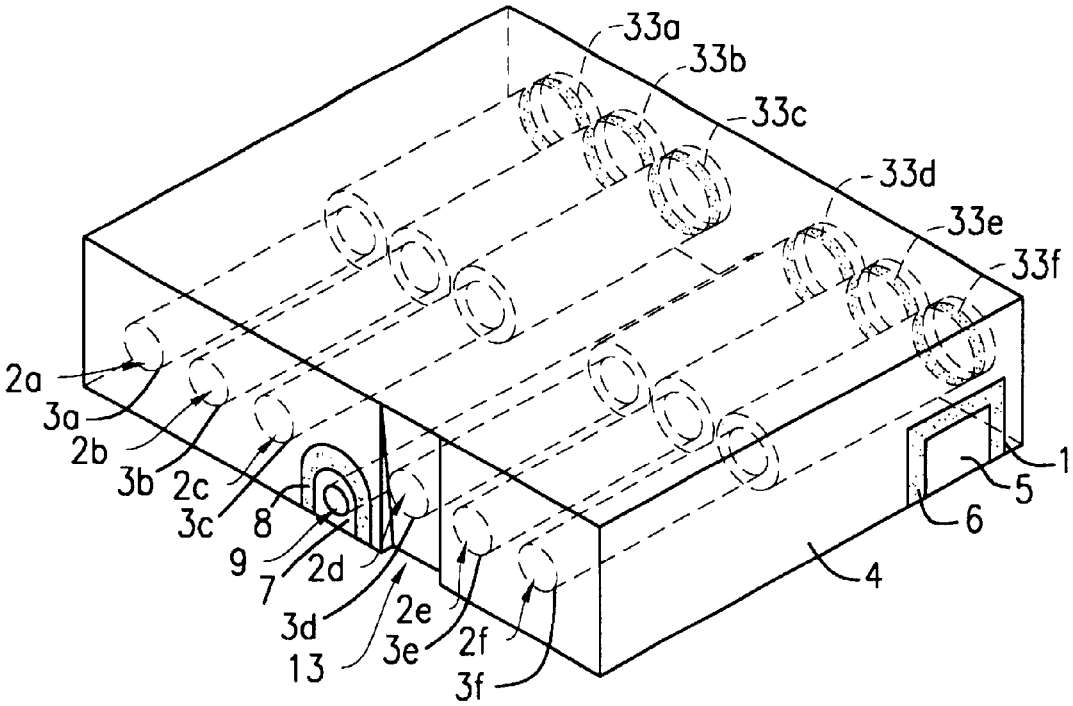
FIG. 9A is an external perspective view of a dielectric duplexer according to a fourth embodiment of the present invention.
Figure 9B:
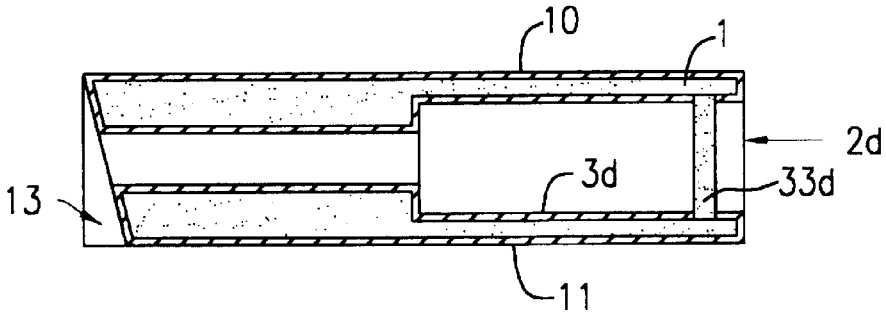
FIG. 9B is a lateral sectional view of the dielectric duplexer shown in FIG. 9A.

Referring to FIGS. 9A and 9B, the structure of a dielectric duplexer according to a fourth embodiment of the present invention will now be described.

FIG. 9A is an external perspective view of the dielectric duplexer. FIG. 9B is a lateral sectional view of the dielectric duplexer.

A substantially-rectangular-parallelepiped-shaped dielectric block 1 contains a plurality of plated through holes 2*a* to 2*f* having respective inner conductors 3*a* to 3*f* formed thereon. An outer conductor 4 is formed on the exterior surface of the dielectric block 1. Inner-conductorless portions 33*a* to 33*f* are provided, in the vicinity of first ends of the plated through holes 2*a* to 2*f* (the right back side in FIG. 9A) respectively, thus forming open ends of resonant cavities formed by the inner conductors. The rear surface of the dielectric block (as viewed in FIG. 9A) located adjacent the open ends of the plated through holes will be referred to as the open end face of the dielectric block 1.

The opposite ends of the inner conductors 3*a* to 3*f* are directly coupled to the outer electrode 4 at the front surface of the dielectric block to form short-circuit ends of the resonant cavities. The front surface of the dielectric block 1 will be referred to as the short circuit end face of the dielectric block. The plated through holes 2*a* to 2*f* preferably have stepped structures in which the internal diameter of the plated through holes 2*a* to 2*f* at the short-circuit end face is smaller than the diameter at the open end face. The inner conductors 3*a* to 3*f*, in conjunction with the dielectric block 1 and the outer conductor 4, form dielectric resonators.

A depression 13 (more generally an indentation) is formed on the short-circuit end face (the front surface of the dielectric block) at the plated through hole 2*d* so that a portion thereof adjacent to the bottom electrode 11 has a predetermined depth (as measured in the axial direction of the through hole 2*d*) and a predetermined width (as measured along a direction parallel to the arrayed direction of the through holes). The outer conductor 4 is formed on the surface of the depression 13.

The input/output terminal 5, the antenna terminal 7, the outer-conductorless portions 6 and 8, the antenna excitation hole 9 are the same as those of the dielectric duplexer shown in FIGS. 1A to 1C.

When arranged as described above, the length of the outer conductor 4 between the short-circuit end of the inner conductor 3*d* and the outer-conductorless portion 8 is increased, and hence the current flowing from the inner conductor 3*d* to the bottom electrode 11 becomes less susceptible to the influence of the outer-conductorless portion 8. Since the connected portion between the top electrode 10 and the short-circuit end face is not trimmed, the current flowing from the inner conductor 3*d* to the top electrode 10 is substantially the same as a case in which the depression 13 is not provided. By changing the shape of the depression 13, the current flowing from the inner conductor 3*d* to the top electrode 10 can be made substantially the same as the current flowing from the inner conductor 3*d* to the bottom electrode 11. The excitation of an undesirable mode is suppressed, and undesirable coupling is prevented. Thus, the attenuation characteristics can be improved.

When forming the depression 13 by trimming the dielectric block 1, the trimming is performed on a dielectric block, which is a preferably block-shaped object. Thus, the trimming operation becomes simpler, and desired characteristics can be easily obtained.

When the shape of the depression 13 is set in advance so that predetermined characteristics can be obtained, and when a corresponding mold is formed, a dielectric duplexer can be easily formed.

In the foregoing embodiments, the dielectric duplexer having a structure in which an inner-conductorless portion is provided in the vicinity of a first aperture of an plated through hole to form an open end of a resonator has been described. Instead of providing an outer conductor at the first aperture of the plated through hole, the rear surface of the dielectric block can be made an open end face without a ground conductor being formed thereon. A coupling electrode for coupling adjacent resonators can be provided in the vicinity of the aperture of the plated through hole on the open end face.

Figure 10:
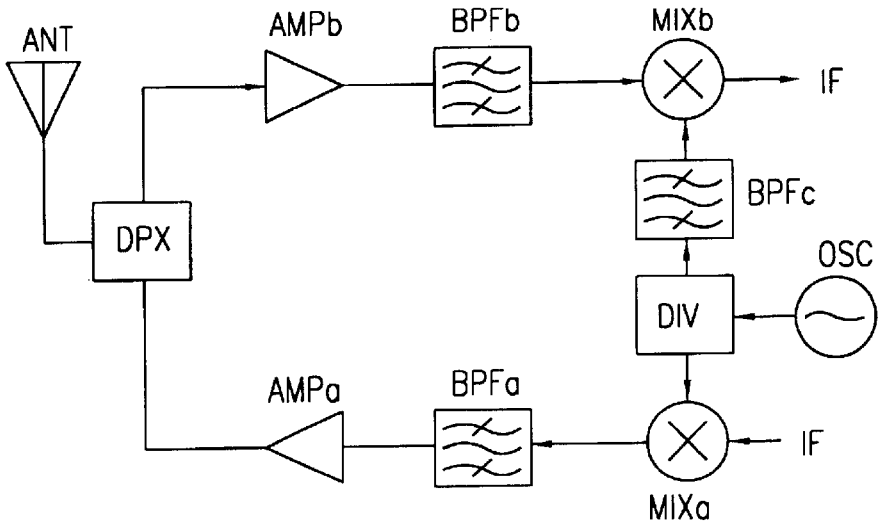
FIG. 10 is a block diagram of a communication apparatus according to the present invention.
Figure 11:
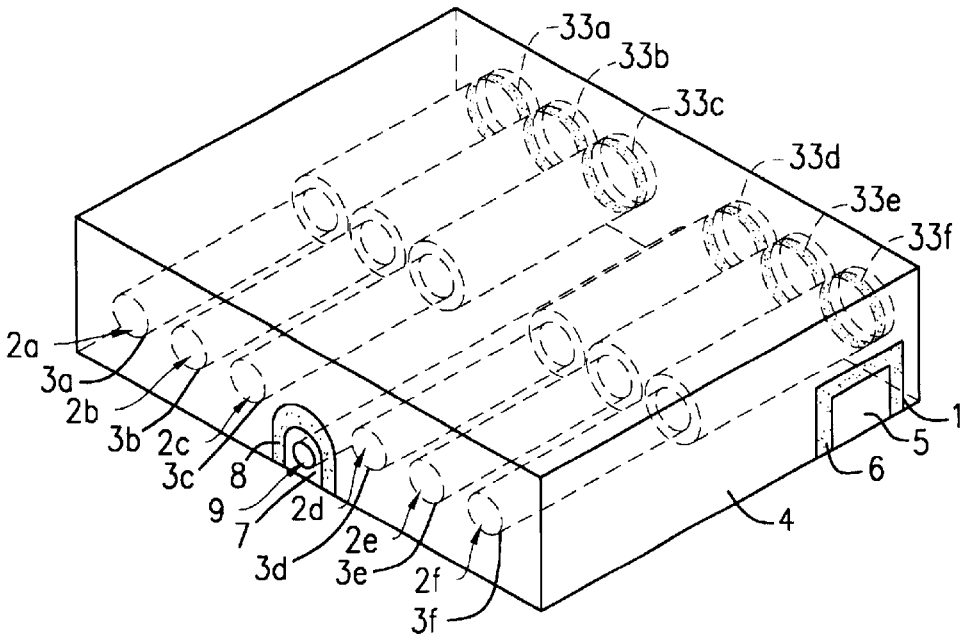
(PRIOR ART) FIG. 11
FIG. 11 is an external perspective view of a known dielectric duplexer.
Figure 12:
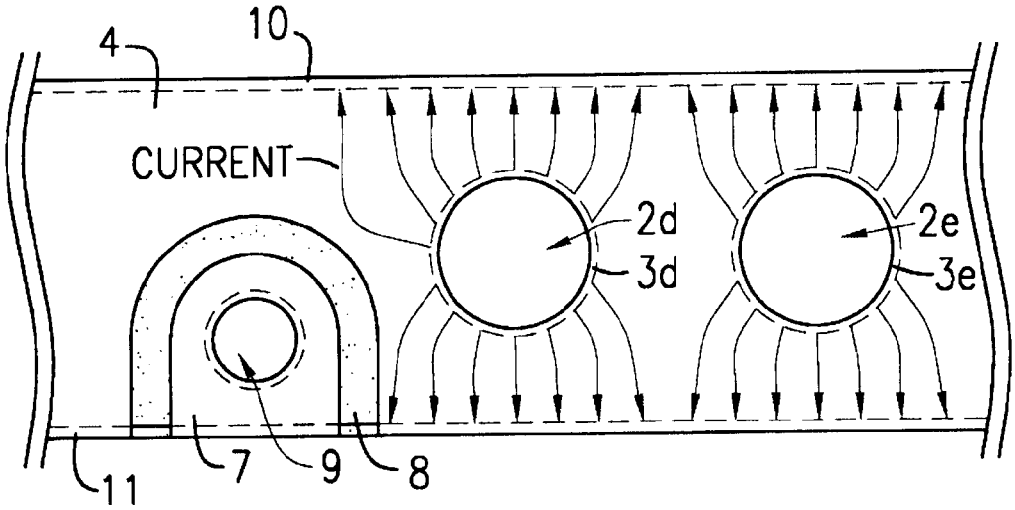
(PRIOR ART) FIG. 12
FIG. 12 illustrates the distribution of ground current at a short-circuit end face of the known dielectric duplexer.

Referring to FIG. 10, the structure of a communication apparatus according to a fifth embodiment of the present invention will now be described.

FIG. 10 is a block diagram of the communication apparatus.

Referring to FIG. 10, the communication apparatus contains a transmitter/receiver antenna ANT, a duplexer DPX, band pass filters BPFa, BPFb, and BPFc, amplifier circuits AMPa and AMPb, mixers MIXa and MIXb, an oscillator OSC, and a frequency divider (synthesizer) DIV. The mixer MIXa modulates a frequency signal output from the frequency divider DIV using an intermediate frequency (IF) signal. The band pass filter BPFa only allows a signal within the transmitter frequency band. The amplifier circuit AMPa amplifies the signal that has passed through the band pass filter BPFa and outputs the signal from the transmitter/receiver antenna ANT through the duplexer DPX. The amplifier circuit AMPb amplifies a signal output from the duplexer DPX. Of the signal output from the amplifier circuit AMPb, the band pass filter BPFb only allows a signal within the receiver frequency band. The mixer MIXb mixes a frequency signal output form the band pass filter BPFc and a receiver signal and outputs an IF signal.

As the duplexer shown in FIG. 10, the dielectric duplexers structured as shown in FIGS. 1A to 1C, FIGS. 3A to 3C, FIG. 6, and FIGS. 9A and 9B can be used. Accordingly, a communication apparatus having improved transmission characteristics can be formed by a simplified overall structure.

What is claimed is:

1. A dielectric duplexer, comprising:

a dielectric block having an outer surface including top, bottom, front and rear surfaces;

a plurality of plated through holes extending through the dielectric block between the front to the rear surfaces thereof, each of the plated through holes having a respective inner conductor formed on an inner surface thereof;

an antenna excitation hole extending through the dielectric block from the front to the rear surface thereof, the antenna excitation hole having an electrode formed on an inner surface thereof;

an outer conductor located on the outer surface of the dielectric block and being directly connected to the inner conductors at the front surface of the dielectric block;

input/output terminals located on the outer surface of the dielectric block and being spaced from the outer conductor;

an antenna terminal located on the front surface and being directly coupled to the antenna excitation hole electrode, the antenna terminal being separated from the outer conductor by a conductorless area extending from the front to the bottom surfaces of the dielectric block; and means for adjusting the relative flow of current through the outer conductor between the inner electrode of a first one of the plated through holes which is located adjacent the antenna terminal and the upper and lower surfaces of the dielectric block so as to cause the two current flows to be substantially equal.

2. The dielectric duplexer of claim 1, wherein the dielectric block is a rectangular parallelepiped.

3. The dielectric duplexer of claim 2, wherein the outer conductor is located on the upper and lower surfaces of the dielectric block.

4. The dielectric duplexer of claim 1, wherein the adjusting means comprises at least one electrodeless portion located on the front face adjacent the antenna excitation hole.

5. The dielectric duplexer of claim 4, wherein the electrodeless portion extends to the conductorless area.

6. The dielectric duplexer of claim 4, further including second adjusting means for adjusting the relative flow of current through the outer conductor between the inner conductor of a second of the plated through holes located adjacent the antenna terminal and the upper and lower surfaces of the dielectric block so as to cause the two current flows to be substantially equal.

7. The dielectric duplexer of claim 6, wherein the second adjusting means comprises at least one second electrodeless portion located on the front face adjacent the antenna excitation hole.

8. The dielectric duplexer of claim 7, wherein the second electrodeless portion extends to the conductorless area.

9. The dielectric duplexer of claim 1, wherein the adjusting means is a portion of the first plated through hole which terminates at the front surface of the dielectric block and is located closer to the bottom surface of the dielectric block than the top surface thereof.

10. The duplexer of claim 9, wherein the first plated through hole has a first portion located half way between the top and bottom surfaces of the dielectric block and a second portion located closer to the bottom surface than the top surface of the dielectric block and terminating at the front surface of the dielectric block.

11. The duplexer of claim 9, wherein the first plated through hole is a straight through hole located closer to the bottom surface of the dielectric block than to the top surface thereof.

12. The duplexer of claim 1, wherein the adjusting means is an indentation formed in the front surface of the dielectric block so as to adjust the relative flow of current between the inner conductor of the first through hole and top and bottom surfaces of the dielectric block.

13. The duplexer of claim 12, wherein the indentation comprises a planar surface extending at an oblique angle to the top and bottom surfaces of the dielectric block.

14. The duplexer of claim 12, wherein the indentation further comprises side walls extending from the planar surface to the front surface of the dielectric block.

15. The duplexer of claim 14, wherein the side walls extend perpendicular to the front surface of the dielectric block.

16. A communication apparatus comprising a dielectric duplexer as set forth in claim 1.

* * * * *